US006745509B1

(12) United States Patent
Lapp

(10) Patent No.: US 6,745,509 B1
(45) Date of Patent: Jun. 8, 2004

(54) INTEGRATED COUPON DISPENSER AND PROMOTIONAL SIGNAGE PRODUCT

(76) Inventor: James Frederick Lapp, 3024 Stony Lake Dr., Richmond, VA (US) 23235

( * ) Notice: Subject to any disclaimer, the term of this patent is extended or adjusted under 35 U.S.C. 154(b) by 0 days.

(21) Appl. No.: 10/236,227

(22) Filed: Sep. 6, 2002

Related U.S. Application Data

(63) Continuation-in-part of application No. 09/938,451, filed on Aug. 24, 2001, now abandoned, which is a continuation-in-part of application No. 09/644,518, filed on Aug. 24, 2000, now abandoned.

(51) Int. Cl.[7] ..... B09F 3/18
(52) U.S. Cl. ..... 40/661; 40/661.03
(58) Field of Search ..... 40/661, 660, 661.06, 40/661.08, 658, 661.03; 206/449

(56) References Cited

U.S. PATENT DOCUMENTS 5,695,061 A * 12/1997 Stompe ..... 206/449
5,848,698 A * 12/1998 Stompe ..... 206/449
6,233,858 B1 * 5/2001 Brach et al. ..... 40/660

* cited by examiner

*Primary Examiner*—Cassandra H. Davis

(57) ABSTRACT

An integrated coupon dispenser and promotional signage product that greatly improves the visibility and eye-catching ability of point-of-purchase (POP) coupon dispensers by integrating a printed card with a coupon-dispensing device. Various integral tab arrangements provided with the coupon dispenser and integrated card allow effortless attachment to a wide variety of desired locations in a retailing establishment. Additional advantages include easy refilling of the dispenser with coupons without dismantling and accommodation for attention-getting devices such as lights and voice modules.

18 Claims, 10 Drawing Sheets

INTEGRATED COUPON DISPENSER AND PROMOTIONAL SIGNAGE PRODUCT

This application is a Continuation-In-Part of U.S. patent application Ser. No. 09/938,451, entitled "Clamshell Coupon-Dispensing Device", filed Aug. 24, 2001 and now abandoned, which in turn is a Continuation-In-Part of U.S. patent application Ser. No. 09/644,518, entitled "Clamshell Promotional Signage Device" filed Aug. 24, 2000 and now abandoned.

FIELD OF THE INVENTION

The present invention relates to coupon dispensers and particularly to a lightweight, transparent clamshell-type coupon dispenser that is adapted for attachment to a wide variety of desired advertising locations, is easily refilled with coupons, and includes an integral promotional signage product that increases visibility and advertising appeal of the dispenser.

BACKGROUND OF THE INVENTION

To stimulate the purchase of a particular product, it is highly desirable for retailers to provide promotional items, such as advertisements and coupons, at the point of purchase. At the retail establishment, the potential customer compares product attributes, prices, and perceived value just prior to making a purchasing decision. There are typically several brands of a given product side-by-side on the shelf making a potential customer's choice difficult. It is therefore very desirous to draw attention to a product by providing a coupon as close as possible to the point of purchase.

An example of a prior art coupon dispenser is given in U.S. Pat. No. 6,053,356 and consists of a box having a stiffening plate and a coil spring and a pad to urge coupons toward a box opening. The box of U.S. Patent '356 includes suction cups attached by means of screws for the purpose of mounting the box to a flat surface. Although the coupon dispenser of U.S. Patent '356 provides a suitable coupon dispenser, it has the disadvantages of being complex, heavy and bulky, restricted to indoor use, and is limited in the manner in which it may be mounted in a retail establishment. The dispenser is complex, heavy and bulky as a result of the many separate parts involved, such as the box, stiffener, metal spring, pad, and suction cups including fasteners. Use of the coupon dispenser of U.S. Patent '356 would be limited to indoors use as a result of its paper construction. This prior art coupon dispenser, as a result of the suction cup fasteners, limits itself to attachment to flat surfaces. The box of U.S. Patent '356 also has a limited advertising space consisting of only the outer surface of the box which may contain printing to draw attention to the coupons within.

U.S. patent application Ser. No. 09/938,451, entitled "Clamshell Coupon-Dispensing Device", filed by the present inventor on Aug. 24, 2001 and incorporated herein entirely by reference, provided a relatively inexpensive coupon dispensing device that can be attached to a variety of typical locations in a retailing establishment, can be easily refilled without dismantling, and can accommodate attention-getting devices such as lights and voice modules. Although this application provided a coupon dispenser that improved upon prior art coupon-dispensing devices, the dispenser was still limited in the amount of advertising space available for catching the potential purchaser's attention. The eye-catching features of the coupon dispenser of U.S. Pat. application Ser. No. 09/938,451 was limited to the inserted light and voice modules and the printing on the coupons which is visible through the transparent walls of the dispenser. Coupons as used in a retail establishment are typically small and therefore present limited a very small printed area for grabbing the potential buyer's attention. So, although the coupon dispenser of U.S. pat. application Ser. No. 09/938,451 improved upon many features of the prior art coupon dispensers, it still provided limited print space for capturing the customer's attention.

The present invention provides an integrated coupon dispenser and promotional signage product that greatly improves the visibility and eye-catching ability of point-of-purchase (POP) coupon dispensers by integrating a printed card with a relatively inexpensive coupon-dispensing device. The coupon dispenser and integrated card include features to allow easy attachment to a wide variety of desired locations in a retailing establishment. Additional advantages include easily refilling of the dispenser with coupons without dismantling and accommodation for attention-getting devices such as lights and voice modules.

OBJECTS OF THE INVENTION

The integrated coupon dispenser and promotional signage product of the present invention therefore provides the advantage of greatly increased printed advertising area, vastly increasing the visibility and eye-catching ability of the coupon dispenser.

The integrated coupon dispenser and promotional signage product of the present invention also provides features to allow easy attachment to a variety of surfaces in a point-of-purchase retailing location.

A further advantage of the integrated coupon dispenser and promotional signage product is that the coupon-dispensing portion can be readily and easily refilled.

An additional advantage of the integrated coupon dispenser and promotional signage product is that it includes the capability to accommodate attention-getting devices such as lights and voice modules.

SUMMARY OF THE INVENTION

The invention is an integrated coupon dispenser and promotional signage product that improves the visibility and effectiveness of coupon dispensing in a point-of-purchase setting. The coupon dispenser consists of a transparent dispenser of clamshell construction. Two panels are connected by an integral hinge and one or both panels include outward extending cavities. A securing arrangement is provided to secure the panels when closed and also to capture and secure a promotional signage card within the panels. Folding the clamshell creates one or more coupon repositories formed by the joining of cavities in mirror-image positions in either panel or between a cavity in one panel and the panel wall in the opposite panel. The coupon dispenser and integrated card include a variety of attachment arrangements to allow easy attachment to a wide variety of substrates in a retailing establishment. A slot may be provided to allow easily refilling of the dispenser with coupons without dismantling it. Recesses are provided in the panels for inclusion of attention-getting devices such as lights and voice modules.

Table of Nomenclature

| Part No. | Part Description |
|---|---|
| 20 | integrated coupon dispenser and promotional signage product (first embodiment) |
| 22 | coupon dispenser |
| 24 | promotional signage product |
| 26 | first panel |
| 28 | second panel |
| 30 | integral hinge |
| 32 | inner surface of first panel |
| 34 | inner surface of second panel |
| 36 | cavity |
| 38 | coupon-dispensing opening |
| 40 | extensions |
| 42 | depressions |

-continued

Table of Nomenclature

| Part No. | Part Description |
|---|---|
| 44 | cutouts |
| 46 | recesses |
| 48 | nubs |
| 50 | apertures (in panel) |
| 52 | flexible tabs |
| 54 | tab apertures |
| 56 | base notches |
| 58 | shouter recess |
| 60 | aperture (for light) |
| 61 | printed characters |
| 62 | enclosure |
| 64 | peripheral flange |
| 72 | price channel |
| 74 | fuel hose |
| 76 | cable tie |
| 78 | suction cup |
| 80 | integrated coupon dispenser and promotional signage product (second embodiment) |
| 82 | extended flange |
| 84 | U-shaped slit |
| 86 | elongated tab |
| 88 | top edge of second panel |
| 90 | front lip of price channel |
| 100 | integrated coupon dispenser and promotional signage product (third embodiment) |
| 102 | bendable tabs |
| 104 | apertures |
| 106 | thin-wall section |
| 108 | registering edges of bendable tabs |
| 110 | flat surface |
| 112 | coupons |

DETAILED DESCRIPTION

Figure 1:
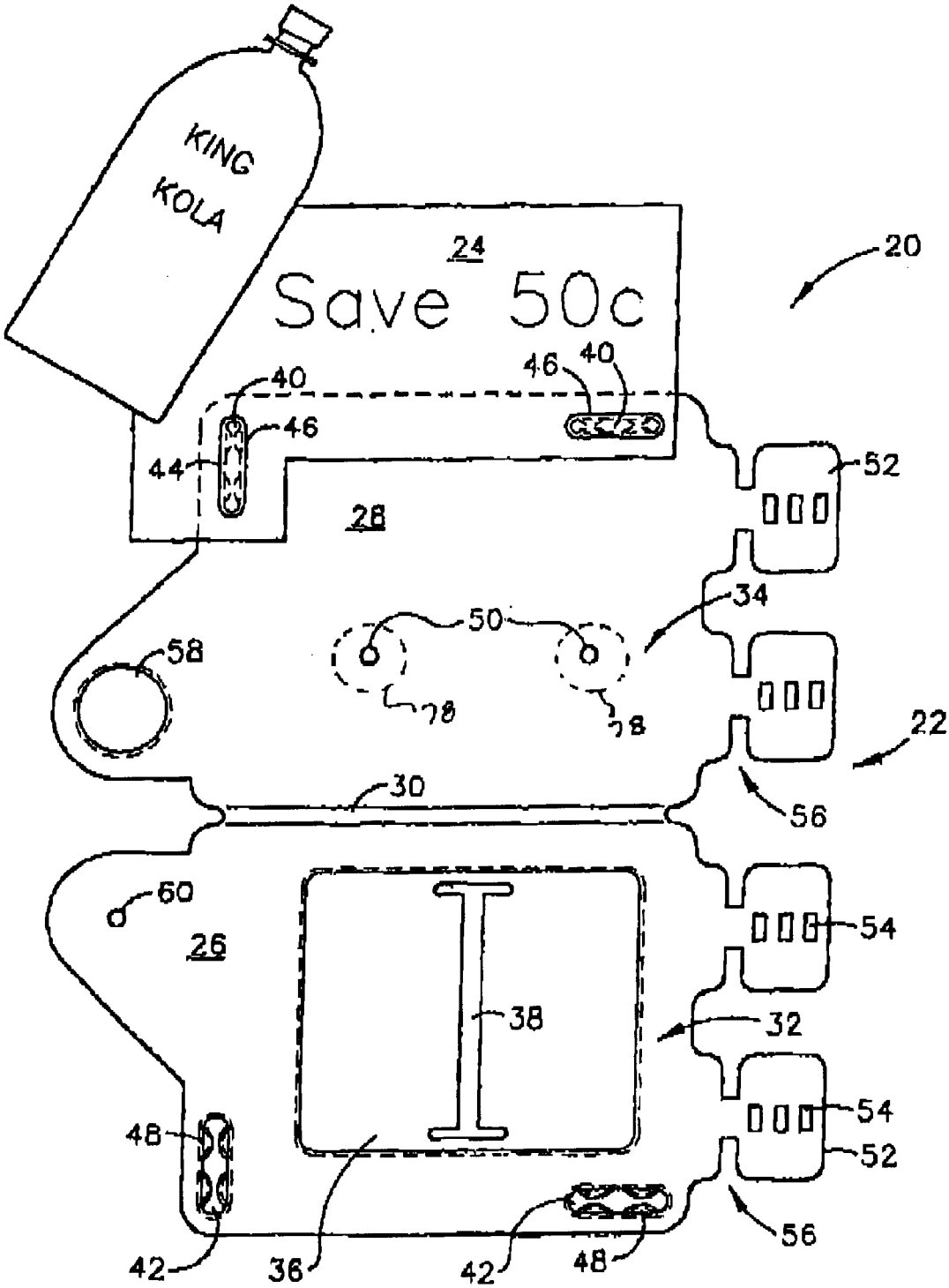
FIG. 1 is a plan view of a first embodiment of the integrated coupon dispenser and promotional signage product of the present invention with the clamshell coupon dispenser in its open configuration and the promotional signage product positioned to be captured by the clamshell dispenser when closed.

Referring to FIG. 1, a first and preferred embodiment of the integrated coupon dispenser and promotional signage product 20 of the present invention is depicted in its open configuration. The integrated coupon dispenser and promotional signage product includes a clamshell-type coupon dispenser 22 and a promotional signage product 24 that is captured securely by the coupon dispenser when it is closed. Typically, the coupon dispenser 22 is transparent and fabricated from a suitable polymer, such as polyethylene or polypropylene, in a thermoforming operation. The coupon dispenser 22 includes a first 26 and a second 28 panel joined by an integral hinge 30. The coupon dispenser 22 is depicted with the inner surfaces 32, 34 of the first 26 and second 28 panels facing the viewer of FIG. 1. The first embodiment of the integrated coupon dispenser and promotional signage product 20 is depicted with a cavity 36 that extends outwardly from the inner surface 32 of the first panel 26. A coupon-dispensing opening 38 is included approximate the mid-point of the cavity 36. A securing arrangement is provided with the coupon dispenser 22 to enable the two panels 26, 28 to be locked together and includes extensions 40 formed in the second panel 28 and depressions 42 in the first panel 26 that will be in alignment upon closure of the panels. The promotional signage product 24 includes cutouts 44 that are provided in an amount equal in number to and in alignment with the extensions 40 in the second panel 28. The cutouts 44 enable the promotional signage product 24 to be overlaid on the extensions 40 in the second panel. The securing arrangement includes one or more recesses 46 formed transversely in the extensions 40 and an equal number of mating nubs 48 formed in the depressions 42 such that closure of the panels 26, 28 about the integral hinge 30 causes the mating nubs 48 to snap fit into the recesses 46 thereby locking the promotional signage product 24 inside the coupon dispenser 22. The promotional signage product 24 typically consists of a printed card that is stiff, thereby causing the promotional signage product 24 to extend from the coupon dispenser 22 when closed therein and not easily fold over or bend.

Several attachment arrangements are provided with the first embodiment of the integrated coupon dispenser and promotional signage product 20 to allow it to be easily anchored in a typical point-of-purchase retailing location, including apertures 50 in the back or second panel 28 that may be later affixed with suction cup members 78 (see FIG. 1 ) to provide a means for securing the dispenser and signage product 20 to a flat surface. An additional attachment arrangement consists of one or more flexible tabs 52 extending from an edge of one or both of the panels 26, 28 of the coupon dispenser 22. The first embodiment is depicted in FIG. 1 with two flexible tabs 52 on each panel 26 and 28, with the flexible tabs 52 in a mirror-image location on each panel such that closure of the coupon dispenser 22 will cause the flexible tabs 52 to register with its matching tab on the opposite panel. The flexible tabs 52 are typically provided with a plurality of tab apertures 54 as shown, and may also be provided with base notches 56 that facilitate attachment of the coupon dispenser 22 to a variety of desired point-of-purchase surfaces and objects as will be later described herein. For increased visual appeal, the coupon dispenser 22 may also be provided with a shouter recess 58 and an aperture 60 for protrusion of a light (not shown) from the shouter recess.

Figure 2:
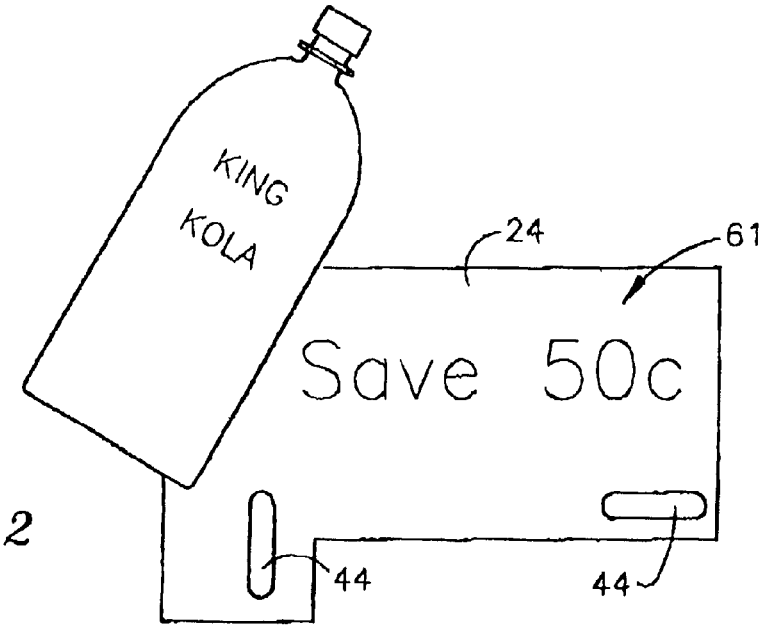
FIG. 2 is a plan view of the promotional signage product portion of the first embodiment shown in FIG. 1.
Figure 3:
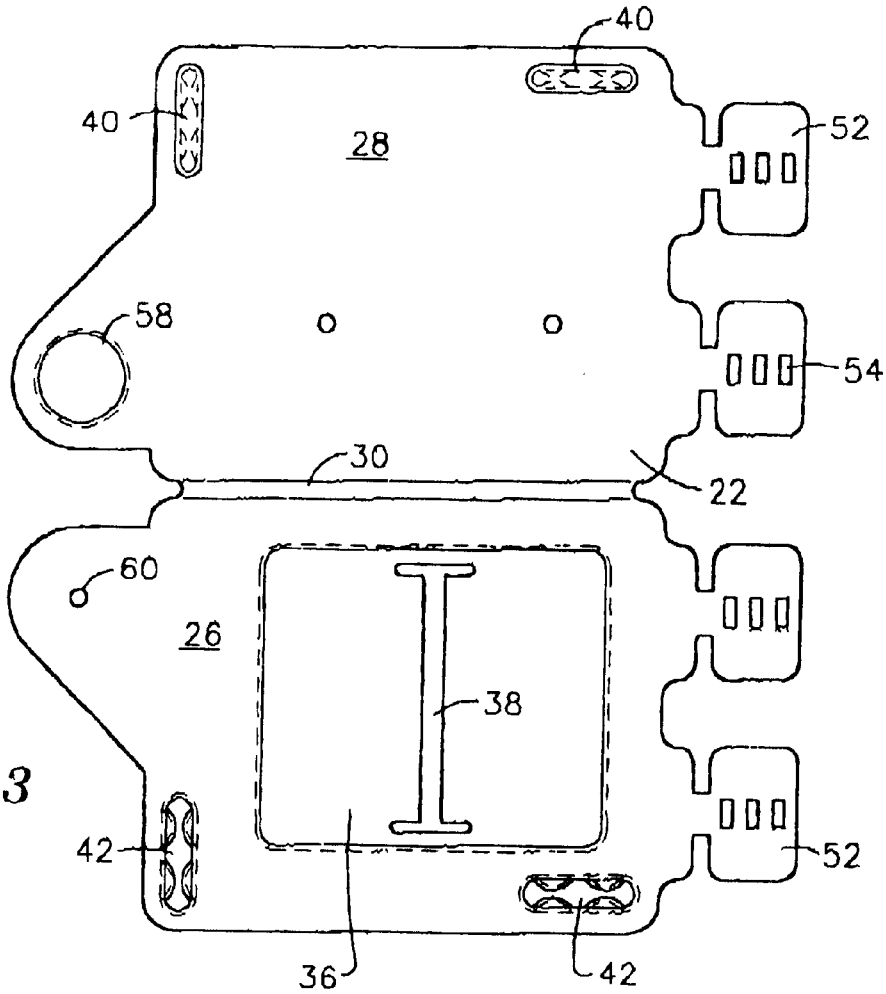
FIG. 3 is a plan view of the integrated coupon dispenser portion of the first embodiment shown in FIG. 1.

Referring now to FIGS. 2 and 3, the cutouts 44 are typically stamped in the promotional signage product 24 such that they will align with the extensions 40 on the back or second panel 28 and the depressions 42 on the front or first panel 26. The promotional signage product 24 is typically contains printed characters 61 in bold colors and letters to draw attention to the coupon dispenser 22 that it will become integral with upon closure of the clamshell-type dispenser.

Figure 4:
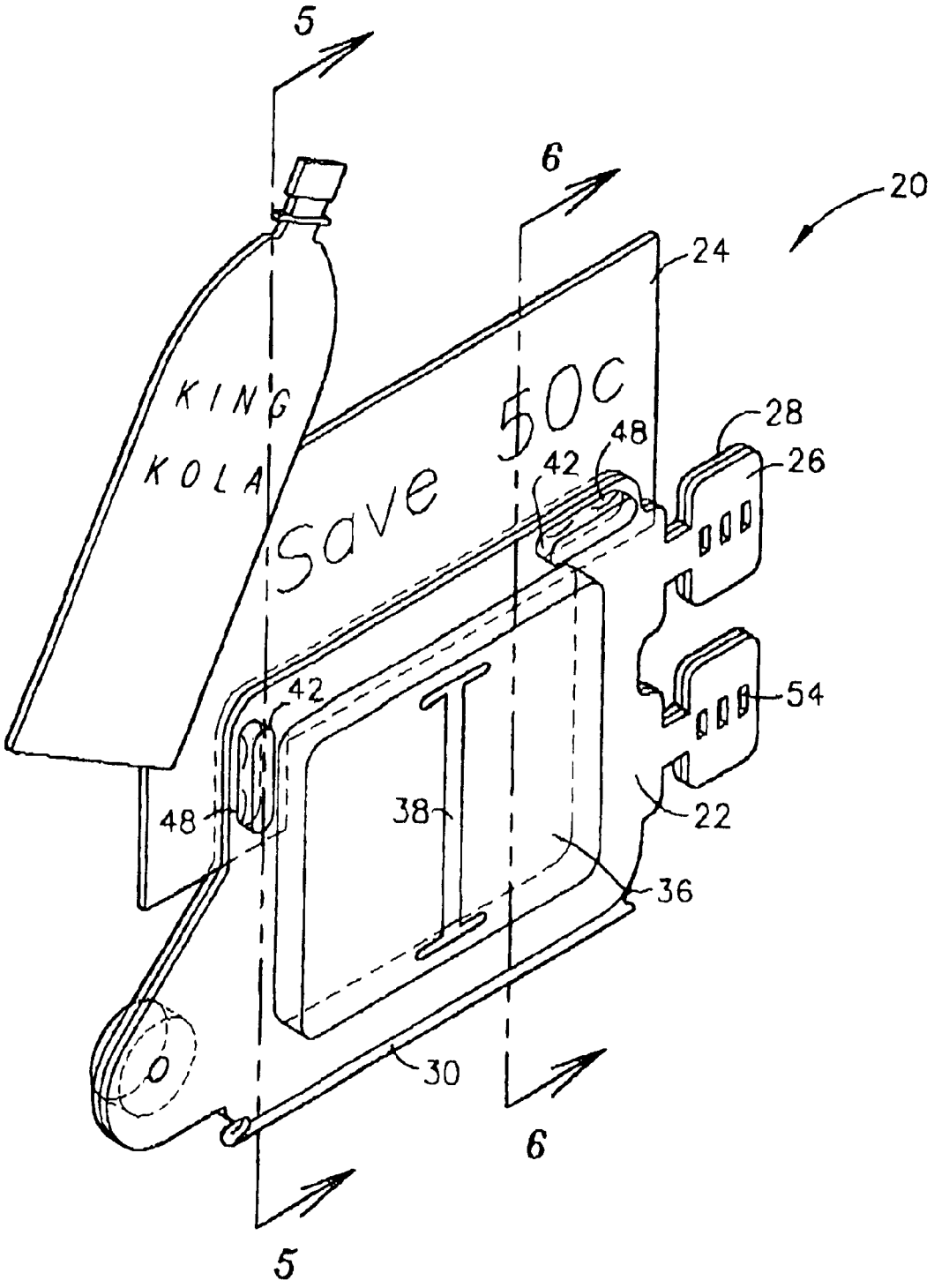
FIG. 4 is a perspective view of the integrated coupon dispenser and promotional signage product of FIG. 1 in its closed state with the promotional signage product secured within the dispenser.

As shown in FIG. 4, once the two panels 26, 28 of the coupon dispenser 22 are closed around the promotional signage product 24, the signage product is held securely by the action of the nubs 48 of the depressions 42 in the first panel 26 snap fitting into the recesses of the extensions (not shown). The promotional signage product 24 typically extends substantially beyond the outer periphery of the coupon dispenser 22 as shown. Provision of a large promotional signage product or card 24 that extends substantially beyond the outer periphery of the coupon dispenser 22, as shown in FIG. 4, greatly increases the eye-catching ability of the coupon dispenser. This dramatic increase in available print area greatly increases the effectiveness of the typical point-of-purchase coupon dispenser, making it much more visible to the shopper and increasing the likelihood the shopper will extract a coupon from the dispenser.

Figure 5:
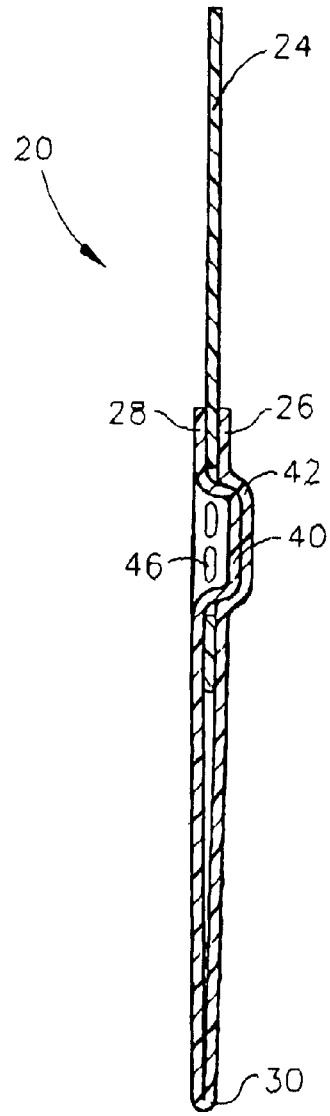
FIG. 5 is a sectional view of the integrated coupon dispenser and promotional signage product taken along line 5—5 of FIG. 4.

Referring now to FIG. 5, a sectional view of the integrated coupon dispenser and promotional signage product 20 taken along line 5—5 of FIG. 4 shows the promotional signage product 24 sandwiched between the first 26 and second 28 panels of the coupon dispenser 22. The panels 26, 28 and card 24 are securely held by the securing arrangement that includes depressions 42 in the first panel 26 that are sized to form a snug fit within extensions 40 in the second panel 28. One or more recesses 46 are formed transversely in the extensions 40 and an equal number of mating nubs (not shown) are formed in the depressions 42 to secure the panels once they are snapped together.

Figure 6:
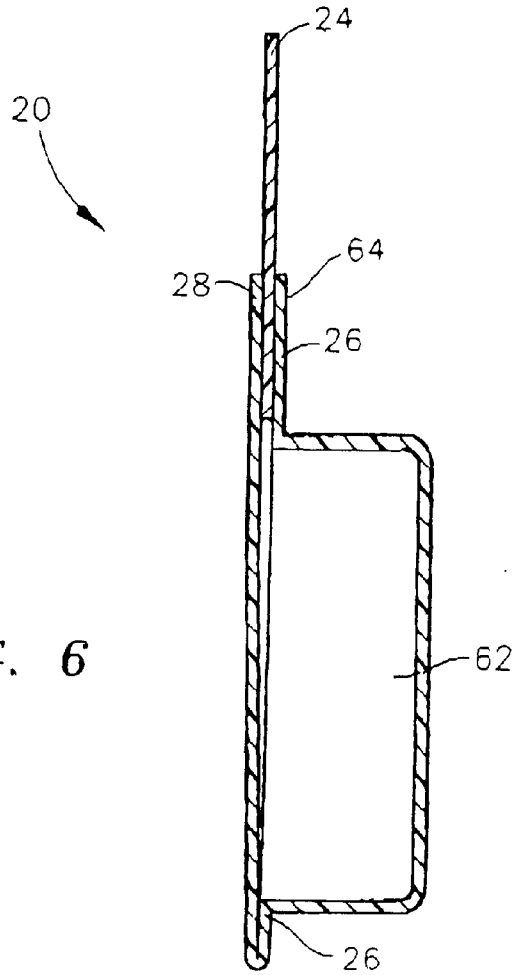
FIG. 6 is a sectional view of the integrated coupon dispenser and promotional signage product taken along line 6—6 of FIG. 4.

As shown in FIG. 6, a sectional view of the integrated coupon dispenser and promotional signage product 20 taken along line 6—6 of FIG. 4, closure of the first 26 and second 28 panels creates an enclosure 62 formed by the second panel 28 sealing around the peripheral flange portion 64 surrounding the cavity 36. The enclosure 62 is available for insertion of printed coupons (not shown).

Figure 9:
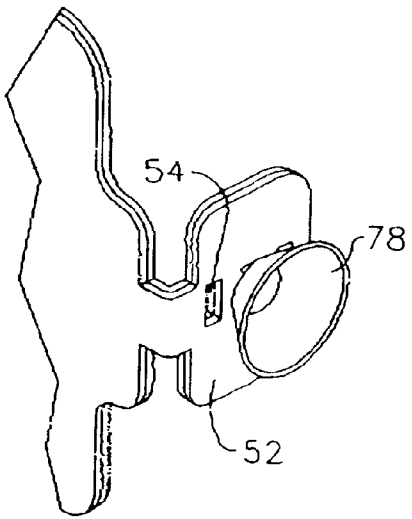
FIG. 9 is a perspective view of the first embodiment of the fastener tab with a suction cup secured thereto.
Figure 8:
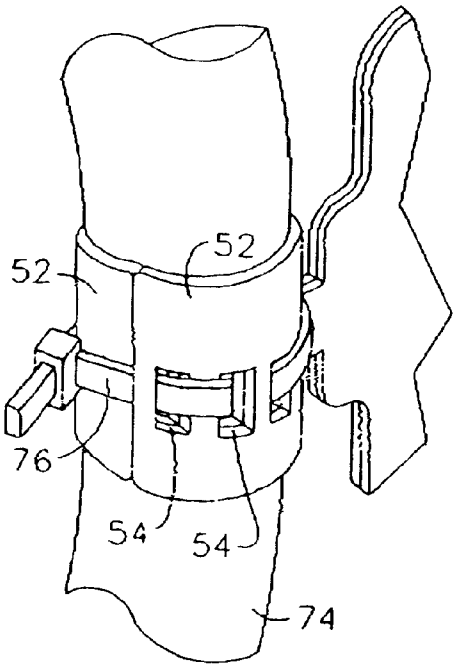
FIG. 8 is a perspective view of the first embodiment of the fastener tab secured to a fuel hose by a cable tie.
Figure 7:
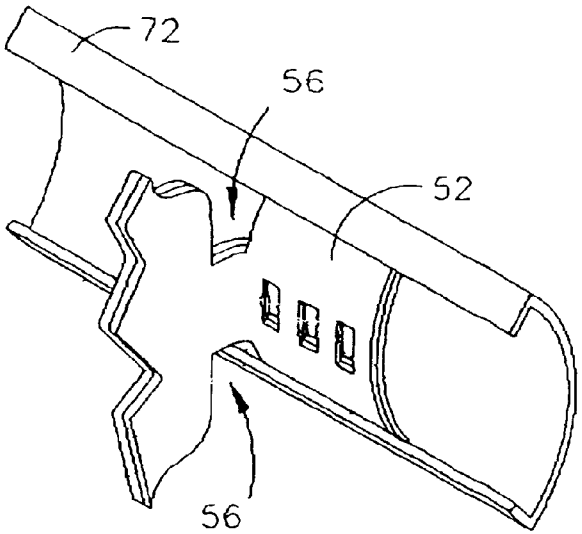
FIG. 7 is a perspective view of a first embodiment of a fastener tab according to the present invention attached to a price channel.

Several typical methods of securing the integrated coupon dispenser and promotional signage product to a typical retail sales location are shown in FIGS. 7 through 9. FIG. 7 shows a cutaway portion of an integrated coupon dispenser and promotional signage product according to the present invention depicting a flexible tab 52 that has been compressed transversely and slipped into a typical price channel 72 in a retail establishment such as a grocery store. The opposing notches 56 allow the flexible tab 52 to bend easily and slip easily into the price channel 72. FIG. 8 depicts the use of the integrated coupon dispenser and promotional signage product as an advertising medium connected to a fuel hose 74 with a cable tie 76 passing through the tab apertures 54 and securing the integrated dispenser and signage product (cutaway portion shown) to the hose 74. FIG. 9 depicts a method of securing the integrated coupon dispenser and promotional signage product (cutaway portion shown) to a flat surface (not shown) that includes snapping a suction cup 78 through one of the available tab apertures 54 as shown.

Figure 10:
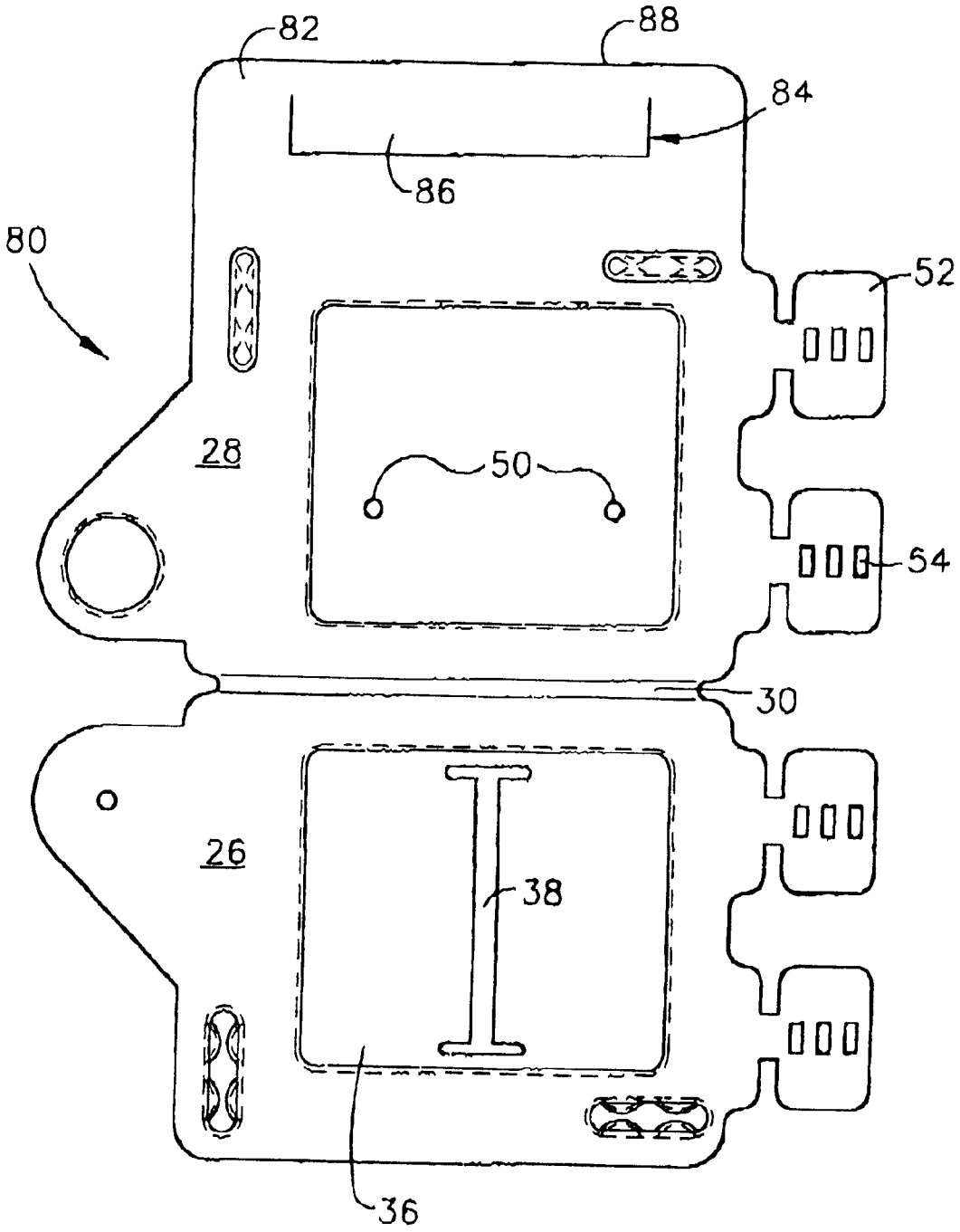
FIG. 10 is a plan view of a second embodiment of the integrated coupon dispenser according to the present invention.
Figure 11:
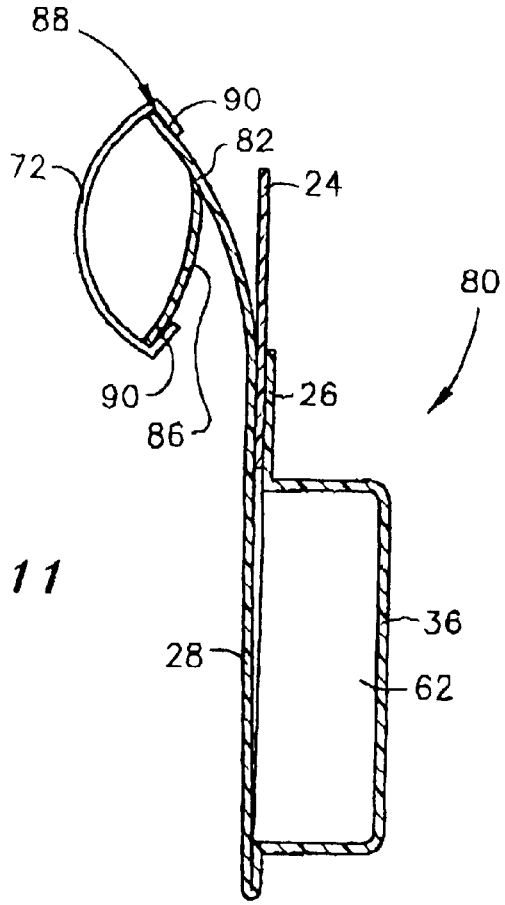
FIG. 11 is a sectional view of the second embodiment of the integrated coupon dispenser with the U-shaped slit of the dispenser inserted into a price channel.

Referring to FIG. 10, a second embodiment of the integrated coupon dispenser and promotional signage product 80 according to the present invention includes an alternate attachment arrangement consisting of an extended flange portion 82 coplanar with the back or second panel 28 and a U-shaped slit 84 formed in the extended flange 82 thereby creating an elongated tab 86. As shown in FIG. 11, the top edge 88 of the second panel 28 can be placed in the top of a price channel 72 and the elongated tab 86 pushed outward of the extended flange 82 and into the bottom portion of the price channel. The top edge 88 of the extended flange 82 and the bottom of the elongated tab 86 thereby are captured by the front lip 90 of the price channel 72 therein securing and supporting the integrated coupon dispenser and promotional signage product 80.

Figure 13:
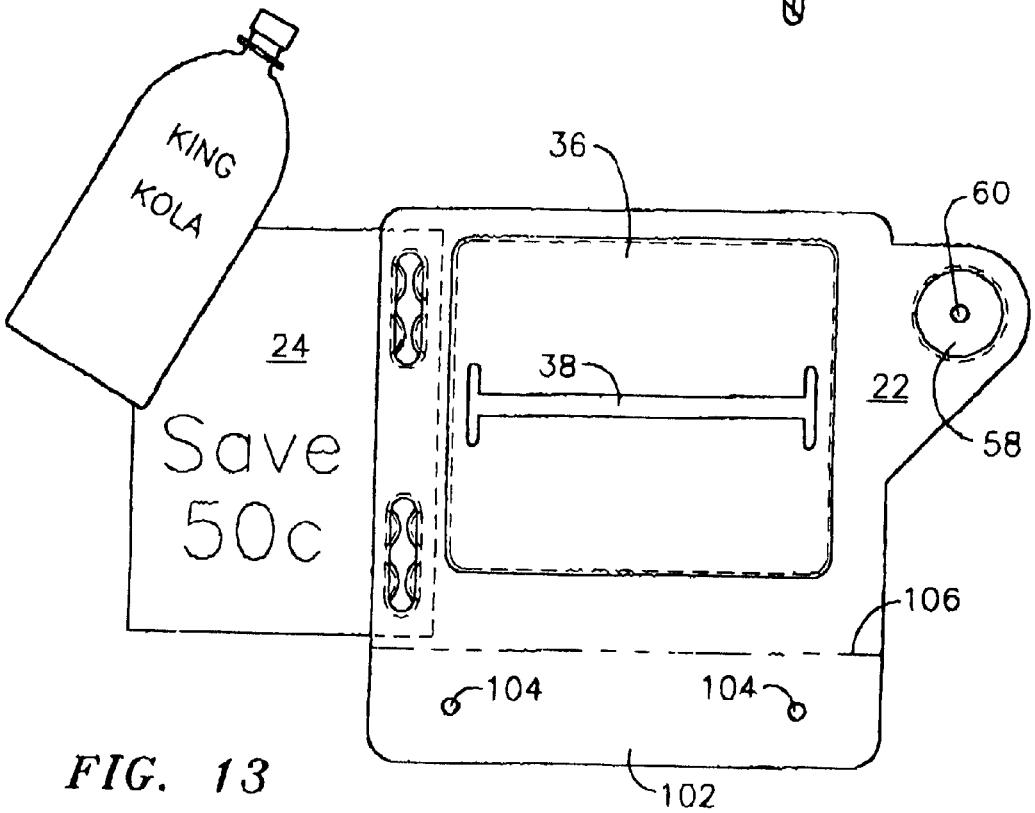
FIG. 13 is a plan view of the third embodiment of the integrated coupon dispenser and promotional signage product of FIG. 12 shown in its closed state.
Figure 12:
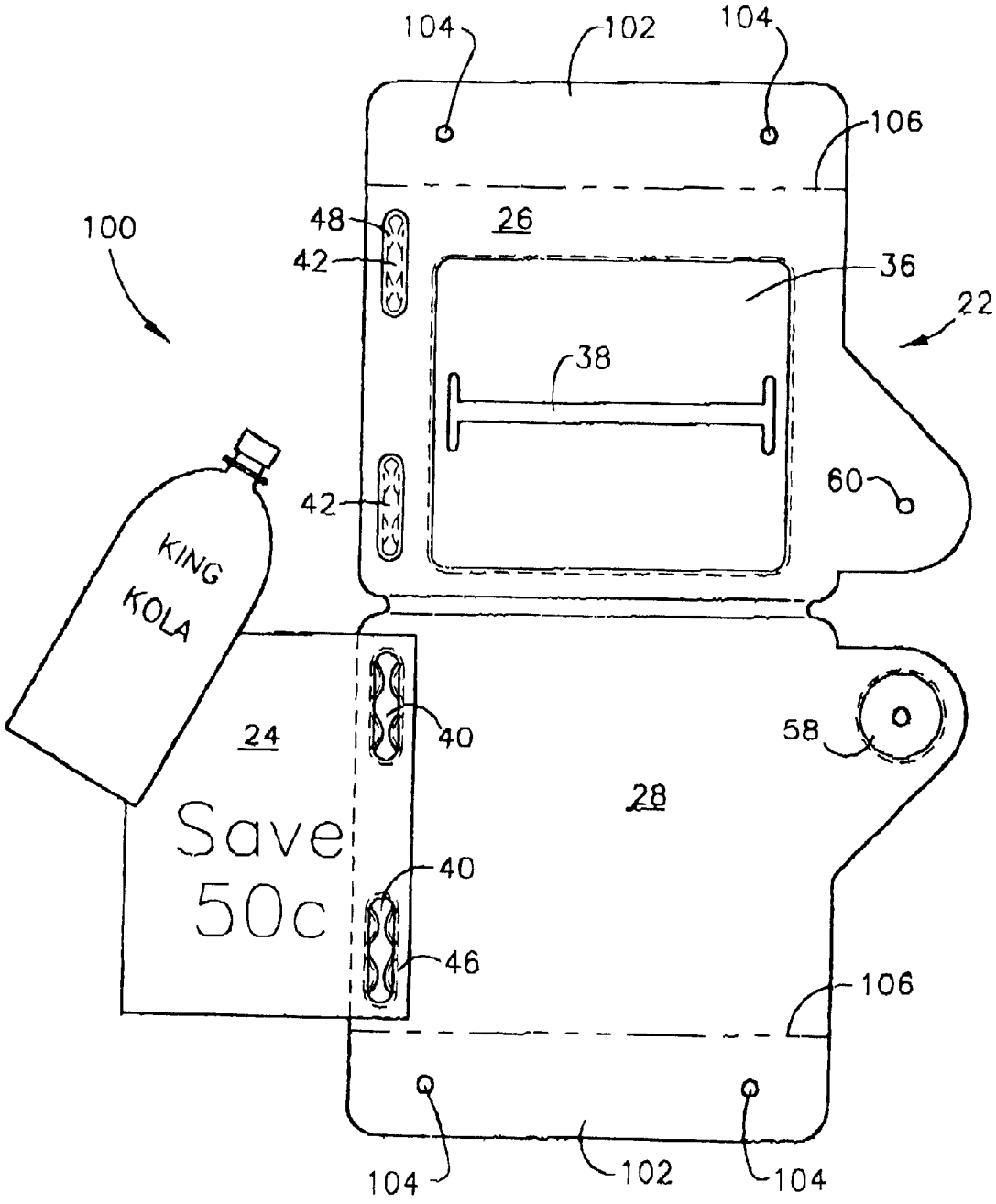
FIG. 12 is a plan view of a third embodiment of the integrated coupon dispenser and promotional signage product in its open configuration and showing a dispenser with bendable tabs and apertures to allow attachment to a flat surface.

Referring to FIG. 12, a third embodiment of the integrated coupon dispenser and promotional signage product 100 includes bendable tabs 102 and apertures 104 to allow insertion of suction cups (not shown) for attachment to a flat surface. The first 26 and second 28 panels typically include thin wall portions 106 (phantom lines) to permit easy bending to form the bendable tabs 102. As shown in FIG. 13, the bendable tabs 102 have registering edges 108 upon closure of the coupon dispenser 22.

Figure 14:
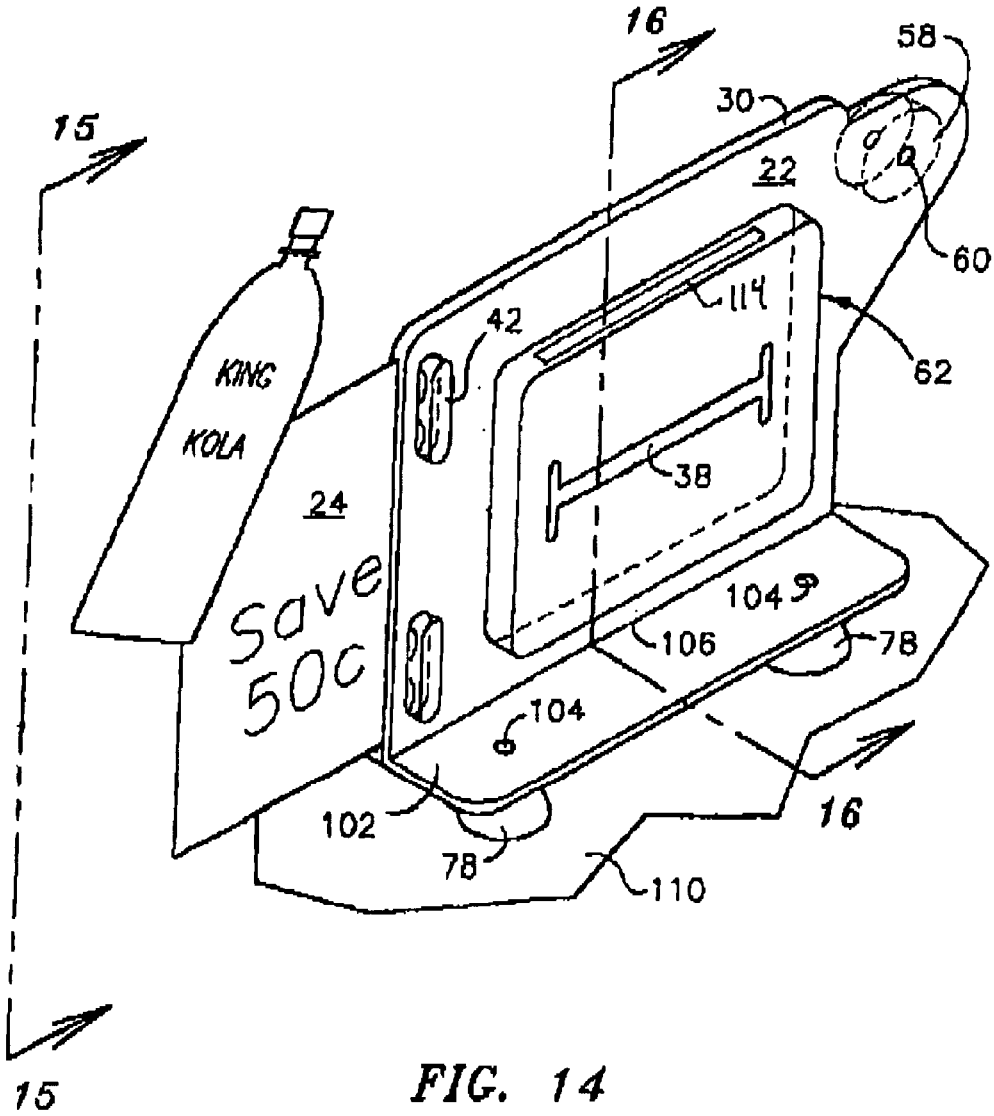
FIG. 14 is a perspective view of the third embodiment of the integrated coupon dispenser and promotional signage product of FIG. 12 with the bendable tabs bent outwards at 90°.
Figure 15:
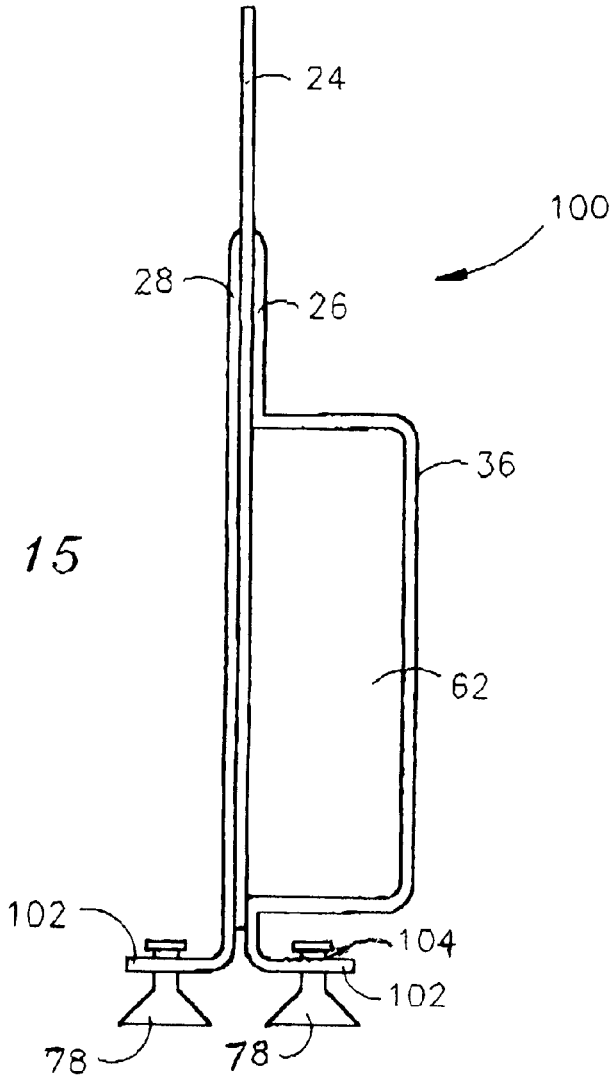
FIG. 15 is an end view of the third embodiment of the integrated coupon dispenser and promotional signage product as viewed along line 15—15 of FIG. 14.

As shown in FIG. 14, the bendable tabs 102 of the third embodiment of the integrated coupon dispenser and promotional signage product 100 may be bent outwards at 90° to enable attachment to a flat surface 110. Alternately, the bendable tabs may be bent to other degrees to accommodate other surfaces, such as one bendable tab left planar with the panel and the opposite bendable tab bent at 90° to accommodate a 90° corner. As shown in the side view of FIG. 15, the third embodiment of the integrated coupon dispenser and promotional signage product 100 provides a coupon enclosure 62 integral with a promotional signage product 24 for attachment to a surface (not shown) via suction cups 78 inserted through apertures 104 in the bendable tabs 102.

Figure 16:
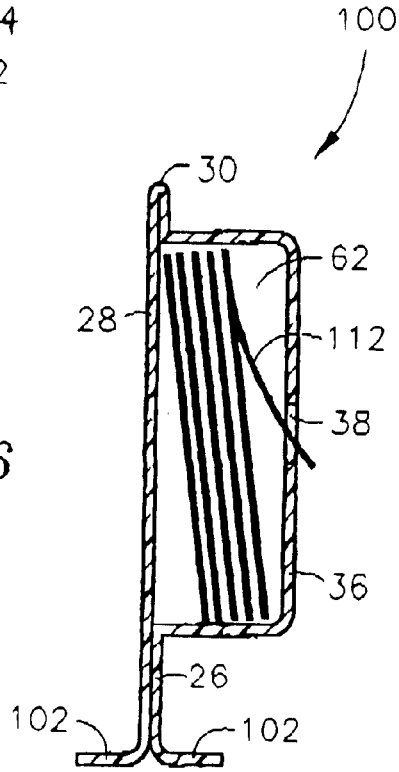
FIG. 16 is a sectional view taken along line 16—16 of FIG. 14.

FIG. 16 is a sectional view taken along line 16—16 of FIG. 14 including a stack of coupons 112 inserted within the coupon enclosure 62 created by the wall of the cavity 36 and the wall of the second panel 28. The top coupon in the stack may be withdrawn by pulling it through the coupon-dispensing opening 38. The bendable tabs 102 are shown bent at 90° from the side panels 26, 28.

Although all embodiments of the integrated coupon dispenser and promotional signage product shown herein depict one cavity formed in one panel, additional cavities could be formed in the same panel to form multiple coupon enclosures, or cavities could be formed in each panel in mirror-image positions thereby forming double-wide coupon enclosures extending outwardly from each side of the closed panels.

The promotional signage product is typically formed from paperboard but can also be formed of any material that exhibits proper stiffness and good print reproduction. The preferred material is therefore paperboard but can also be plastic, wood, or metal.

The preferred method of forming the promotional signage product is by printing and die-cutting paperboard.

The coupon dispensing opening can be oriented in a horizontal or vertical direction to allow stacking and withdrawal of coupons in the manner preferred by the user.

Coupons are typically stacked together without adhesive with alternate folds from either side such that withdrawal of the top coupon causes the top of the next coupon in the stack to advance through the coupon-dispensing opening. Alternately, coupons may also be attached together on alternating edges in accordion fashion and withdrawn individually without any tacky residue remaining after removal, such as the pad of adhesively secured sheets described in U.S. Pat. No. 6,153,278 to Taylor Corporation of North Mankato, Minnesota.

The integrated coupon dispenser and promotional signage product of the present invention may be made suitable for display outdoors by constructing it such that the hinge is located at the top of the dispenser and by providing a promotional signage product that is waterproof and printed with waterproof inks. An example of a waterproof embodiment is shown in FIG. 14 which depicts the hinge 30 located at the top of the integrated coupon dispenser and promotional signage product 100. This embodiment also could be modified to accommodate other attachment arrangements, such as replacing the bendable tabs 102 with flexible tabs (not shown) to allow attachment to hoses or similar objects. The flexible tabs could be located on the side of the coupon dispenser 22 as well as the bottom.

For indoor use, the integrated coupon dispenser and promotional signage product of the present invention could be provided with a replenishment slot 114 (see FIG. 14) to allow easy refilling of the coupon enclosure. The replenishment slot would typically be located on the top of the cavity.

Methods for the production of the coupon-dispensing device of the present invention are well known in the art. For example, blow molding, thermoforming, or injection molding of transparent plastics is well known and entirely appropriate for production of the present invention. The coupon-dispensing device of the present invention is preferably molded from a transparent plastic material so that the major surfaces, such as the panels, are transparent and allow potential customers to view the printed coupons within.

As alluded to hereinabove, the various embodiments of the coupon dispensing, device of the present invention, in addition to being suitable for the dispensing of coupons, can also be used to display sample products by the simple expedient of modifying one or both of panels 26, 28 to accept the specified product sample in the molding process and eliminating any dispensing apertures.

As the invention as been described, it will be apparent to those skilled in the art tat the same may be varied in many ways without departing from the spirit and scope of the invention. Any and all such modifications are intended to be included within the scope of the appended claims.

What is claimed is:

1. An integrated coupon dispenser and promotional signage product comprising:

a) a first and a second panel joined by an integral hinge such that closure of said panels about said hinge forms closed panels including inner and outer surfaces;

b) one or more cavities extending from said outer surfaces of said panels;

c) said cavities including transparent walls;

d) said inner surface of said first panels including one or more depressions;

e) said inner surface of said second panels including one or more extensions in alignment with said depressions;

f) a promotional signage card including one or more cutout areas with said cutout areas in alignment with said extensions;

g) said extensions extending through said cutouts and mating with said depressions when said panels are closed about said hinge;

h) a securing arrangement for holding said panels closed;

i) a dispensing opening in the side wall of at least one of said cavities;

j) an attachment arrangement for anchoring said coupon dispenser and promotional signage product to an object; and k) an enclosure formed by said walls of said cavities and said inner surface of said panels, said enclosure capable of holding a stack of coupons and said dispensing opening enabling withdrawal of a coupon from said stack.

2. The integrated coupon dispenser and promotional signage product of claim 1 wherein said securing arrangement includes one or more recesses formed transversely in said extensions and an equal number of mating nubs formed in said depressions such that closure of said panels around said hinge causes said mating nubs to snap fit into said recesses thereby securing said promotional card within said first and second panels.

3. The integrated coupon dispenser and promotional signage product of claim 1 wherein said attachment arrangement includes one or more flexible tabs extending from an edge of one or both of said panels with said flexible tabs including base notches which allow said tabs to be flexed to enter a price channel and be held therein by said tabs returning to their unbiased state.

4. The integrated coupon dispenser and promotional signage product of claim 1 wherein said attachment arrangement includes one or more flexible tabs extending from an edge of one or both of said panels;

two or more apertures in said tabs;

said tabs wrapped around a tubular object; and a cable tie or twist tie disposed through said apertures and around the tubular object and fastened thereto.

5. The integrated coupon dispenser and promotional signage product of claim 1 wherein said attachment arrangement includes one or more flexible tabs inserted into a C-channel sign holder.

6. The integrated coupon dispenser and promotional signage product of claim 1 wherein said attachment arrangement includes one or more flexible tabs extending from an edge of one or both of said panels, one or more apertures in said tabs, and suction cups secured in said apertures.

7. The integrated coupon dispenser and promotional signage product of claim 1 wherein said attachment arrangement includes a top edge on said second panel;

a U-shaped slit in said second panels proximate said top edge;

a bottom edge on said U-shaped slit;

a price channel having a top portion and a bottom portion; and said second panel capable of being flexed and snapped into said price channel such that said top edge of said second panel resides in and is supported by said top portion of said price channel and said bottom edge of said U-shaped slit resides in and is supported by said bottom portion of said price channel.

8. The integrated coupon dispenser and promotional signage product of claim 1 wherein said attachment arrangement includes one or more apertures in one of said panels, and suction cups secured in said apertures.

9. The integrated coupon dispenser and promotional signage product of claim 1 wherein said cavities include an open slot along a top edge, said open slot enabling easy refilling of said cavities with coupons.

10. The integrated coupon dispenser and promotional signage product of claim 1 wherein said cavities are two in number and are formed in each of said panels in a mirror-image location such that, upon closure of said panels about said hinge, the walls of said cavities define a coupon holding enclosure extending transversely from both sides of said panels.

11. The integrated coupon dispenser and promotional signage product of claim 1 further including a recess in one or both of said panels for the receipt of a shouter.

12. The integrated coupon dispenser and promotional signage product of claim 1 further including a shouter recess and an aperture therein for protrusion of a light from said display device.

13. The integrated coupon dispenser and promotional signage product of claim 1 wherein said promotional signage card contains printed characters in large conspicuous letters to call attention to said coupon dispenser.

14. The integrated coupon dispenser and promotional signage product of claim 1 wherein said closed panels include an outer periphery; and said promotional signage card extends substantially beyond a said outer periphery of said closed panels.

15. The integrated coupon dispenser and promotional signage product of claim 1 wherein said dispenser opening is a vertical slot.

16. The integrated coupon dispenser and promotional signage product of claim 1 wherein said dispenser opening is a horizontal slot.

17. An integrated coupon dispenser and promotional signage product comprising:

a) a first and a second panel joined by an integral hinge such that closure of said panels about said hinge forms closed panels including inner and outer surfaces;

b) one or more cavities extending from said outer surfaces of said panels;

c) said cavities including transparent walls;

d) said inner surface of said first panels including one or more depressions;

e) said inner surface of said second panels including one or more extensions in alignment with said depressions;

f) a promotional signage card including one or more cutout areas with said cutout areas in alignment with said extensions;

g) said extensions extending through said cutouts and mating with said depressions when said panels are closed about said hinge;

h) a securing arrangement including one or more recesses formed transversely in said extensions and an equal number of mating nubs formed in said depressions such that closure of said panels around said hinge causes said mating nubs to snap fit into said recesses thereby securing said promotional card within said first and second panels;

i) a dispensing opening in the side wall of at least one of said cavities;

1) an attachment arrangement for anchoring said coupon dispenser and promotional signage product to an object; and j) an enclosure formed by said walls of said cavities and said inner surface of said panels, said enclosure capable of holding a stack of coupons and said dispensing opening enabling withdrawal of a coupon from said stack.

18. An integrated coupon dispenser and promotional signage product comprising:

a) a first and a second panel joined by an integral hinge such that closure of said panels about said hinge forms closed panels including inner and outer surfaces;

b) one or more cavities extending from said outer surfaces of said panels;

c) said cavities including transparent walls;

d) said inner surface of said first panels including one or more depressions;

e) said inner surface of said second panels including one or more extensions in alignment with said depressions;

f) a promotional signage card including one or more cutout areas with said cutout areas in alignment with said extensions;

g) said extensions extending through said cutouts and mating with said depressions when said panels are closed about said hinge;

h) a securing arrangement including one or more recesses formed transversely in said extensions and an equal number of mating nubs formed in said depressions such that closure of said panels around said hinge causes said mating nubs to snap fit into said recesses thereby securing said promotional card within said first and second panels;

i) a dispensing opening in the side wall of at least one of said cavities;

j) an attachment arrangement for anchoring said coupon dispenser and promotional signage product to an object, said attachment arrangement including one or more flexible tabs extending from an edge of one or both of said panels with said flexible tabs including notches near the base of said tabs which allow said tabs to be flexed to enter a price channel and be held therein by said tabs returning to their unbiased state; and k) an enclosure formed by said walls of said cavities and said inner surface of said panels, said enclosure capable of holding a stack of coupons and said dispensing opening enabling withdrawal of a coupon from said stack.

* * * * *